US005567278A

United States Patent [19]

Meinander

[11] Patent Number: 5,567,278

[45] Date of Patent: Oct. 22, 1996

[54] PROCESS AND APPARATUS FOR CIRCULATING BACKWATER IN A PAPERMAKING MACHINE

[75] Inventor: Paul O. Meinander, Grankulla, Finland

[73] Assignee: POM Technology Oy Ab, Grankulla, Finland

[21] Appl. No.: 331,537

[22] PCT Filed: May 19, 1993

[86] PCT No.: PCT/FI93/00214

§ 371 Date: Nov. 3, 1994

§ 102(e) Date: Nov. 3, 1994

[87] PCT Pub. No.: WO93/23612

PCT Pub. Date: Nov. 25, 1993

[30] Foreign Application Priority Data

May 19, 1992 [FI] Finland ..... 922285

[51] Int. Cl.[6] ..... D21F 1/66

[52] U.S. Cl. ..... 162/190; 162/189; 162/264; 162/335; 162/337

[58] Field of Search ..... 162/190, 189, 162/203, 264, 299, 301, 335, 337, 339, 359

[56] References Cited

U.S. PATENT DOCUMENTS

| | | | |
|---|---|---|---|
| 3,801,436 | 4/1974 | Prechtel | 162/264 |
| 3,823,062 | 7/1974 | Ward et al. | 162/203 |
| 4,477,313 | 10/1984 | Andersson | 162/123 |
| 4,504,358 | 3/1985 | Hakansson | 162/264 |
| 5,002,633 | 3/1991 | Maxham | 162/5 |
| 5,234,480 | 8/1993 | Henricson et al. | 95/243 |

FOREIGN PATENT DOCUMENTS

| | | |
|---|---|---|
| 9203613 | 3/1992 | WIPO . |
| 9323610 | 11/1993 | WIPO . |
| 9323135 | 11/1993 | WIPO . |
| 9323609 | 11/1993 | WIPO . |

OTHER PUBLICATIONS

Meinander, Paul Olof, "Easy grade changes are in the pipe line", Pulp & Paper International, May 1993, pp. 61, 63.

Henrik Nisser: *The Formator Method—a Road to More Homogenious Formation*, Summary of Patent Application: Process and Apparatus for Circulating Backwater in a Papermaking Machine.

H. J. Shultz: *Practice and Theory of Paper Production on the Example of the Sheet Formation*, Summary of Patent Application: Process and Apparatus for Circulating Backwater in a Papermaking Machine.

*Primary Examiner*—Donald E. Czaja
*Assistant Examiner*—Calvin Padgett
*Attorney, Agent, or Firm*—Browdy and Neimark

[57] ABSTRACT

The invention relates to a process and an apparatus for recycling backwater in a papermaking machine. According to the invention backwater draining through a forming fabric is collected into several collecting means (51, 52, 53, 54) and pumped by separate pumps (20) in at least two and preferably numerous separate flows (81 to 85) directly as substantially air free separate flows to the fibre process (12, 30, 40) of the short circulation in order to implement a fast, air free and split recycling of backwater from said forming fabric to said fibre process.

31 Claims, 6 Drawing Sheets

PROCESS AND APPARATUS FOR CIRCULATING BACKWATER IN A PAPERMAKING MACHINE

The present invention relates to a process and apparatus for the circulation of papermaking machine backwater. Particularly the invention relates to a process, which provides a fast and exact control of the papermaking process and which significantly reduces the time needed for changing the paper grade produced. The process according to the invention especially presents measures by which the recycling time for backwater is significantly reduced. The apparatus according to the invention is designed to serve the principle of a controlled and fast recycling of back water.

In a conventional papermaking process the paper stock, prepared in a separate stock preparation department, goes through the following phases, which constitute the primary process: after consistency control the stock is fed as a constant flow to the papermachine approach system, where it is brought close to a mixing pump, in which it is diluted and mixed to a consistency suitable for cleaning n centrifugal cleaners; the mixing pump pumps this thin stock to primary centrifugal cleaners, where debris is separated by means of the centrifugal force; the accept is brought either directly or via a second mixing pump to one or more primary pressurized screens, from where it is forwarded to the papermachine headbox via an appropriate dilution system; the headbox distributes the diluted stock evenly on an endless forming wire, or in some cases between two such wires, through which the major part of the water contained in the thin stock is drained, leaving a consolidated fibre web on the wire, from which it is transferred to the following phases of paper making, typically pressing and drying.

In the conventional primary fibre process parts of the stock are deviated and circulated in secondary loops. This is particularly the case with the rejects of cleaners and screens which, due to a poor selectivity of these devices, contain good fibres, typically 10 to 30% of the material handled in the primary stage. Said rejects are diluted in mixing pumps and recovered in secondary cleaning stages which may be numerous, each handling the reject of a previous stage and recycling the accepts upstream to a previous stage or into the primary fibre process.

A significant part, typically 5 to 50% of the solids of the thin stock follows the water drained through the forming wire and is circulated back into the fibre process with the backwater. In a traditional papermaking process said backwater passes through backwater pans and channels into a backwater tank, where said water is collected and which feeds the mixing pumps mentioned above. The backwater contains a significant amount of air which would disturb the fibre process and web forming and which therefore has to be removed. This is achieved by letting the flow speeds in the backwater tanks and channels be low, or by letting the entire thin stock flow pass through separate deaeration tanks.

The process in which backwater is recycled from web forming into the fibre process immediately prior to paper forming, and thick stock supplied from the stock preparation is diluted to forming consistency, fed to the headbox and drained as explained above, constitutes the "short circulation". Due to the consistency difference between thick stock and the fibre web leaving the forming part of the paper machine, and various other additions of water into the process, an excess of backwater results and is circulated to the stock preparation as a "long circulation". Mostly the solid material in water flowing to said long circulation is recovered and returned to the short circulation or the fibre process by means of savealls.

At a change in the composition of the thick stock fed from the stock preparation, or in other process conditions influencing the composition of backwater, the great amount of material circulating in the backwater will delay reaching of an equilibrium state. Each time the water of the short or the long circulation passes the web forming zone a certain share of the circulating material, corresponding to a so called retention factor is retained by the wire. The removal of residual material, and thus the response to adjustment of the process, directly depends on the cycle time of the backwater circulations. Big circulating water volumes and extended circuit times thus delay the adjustment of the process, and thus also the reaching of an acceptable product quality after a grade change or process adjustment.

The numerous recycling loops make the system complicated and slow. This is further accentuated by the large volumes of the open backwater tanks. Although is known that keeping the flow rate in a pipe at or above 3 meters per second will prevent slime and dirt from forming on the walls of that pipe slow flow rates are necessary for avoiding mixing of air into the backwater and for letting it escape when mixed. This provides an ideal environment for biological activity producing slime and for the buildup of material deposits in dead corners in the system. Due to the frequently undefined and variable open surfaces of the tanks the volume of the system is not defined exactly enough for a precise control of the flows.

Such a papermaking process is very complicated and sensitive to disturbances and has, therefore, traditionally been designed for achieving best possible stability. As a consequence thereof said process is only slowly controllable. It is true that any process disturbances actually act slowly but correcting them is also slow. The great amount of material circulating in the circulations is particularly harmful at the event of changing the paper grade produced. The stabilization of the product quality takes several minutes and for example a change of the paper color can last more than an hour, even days. This has rendered a "Just On Time" production, as commonly established in the manufacturing industry, impossible in the papermaking industry. Also normal process adjustments are often difficult due to this inherent slowness. Further, the system has to be washed at regular intervals which causes costs and productivity losses.

The many ramifications and feedback loops of a conventional papermaking process further make the process difficult to survey, especially as the various feedback loops set limits to the permissible flow volumes of each other.

Several attempts have been made in the prior art for improving the process of papermaking.

In an international Patent Application published under number WO 92/03613, by Kaj Henricsson et al, discloses a process in which air-removing pumps are used for feeding paper stock to and in the short circulation of a papermaking machine, reducing the need for deaeration by other means. In said process a first portion of the white water is pumped by an air-removing pump from a suction box under the forming fabric to the short circulation while a second portion of the white water is collected in an open water-collection tray.

Henrik Nisser, in Das Papier 39 (1985) 10 A, p. V151 to V159, describes a paper web former, wherein the sheet formation is made in a hydraulically closed space. The apparatus was developed for improving sheet formation.

This apparatus, however, has not performed satisfactorily, and the method does not permit dewatering to a dryness content which corresponds to the dryness of thick stock. The method proposed by Nisser has thus remained without practical application.

Hans-Joachim Schulz, in Das Papier 43 (1989) 10 A, p. V192 to V193, describes a method for the distribution of fibre suspension in the cross machine direction, particularly after the pressure pulse attenuator of a hydraulic headbox. This method has been used in practice when forming a paper web using foam as the medium.

The object of the present invention is to provide and improvement of conventional papermaking process by reducing water volumes and eliminating the need for water tanks.

The object of the present invention is also to provide a papermaking process which is significantly more readily controllable than conventional papermaking processes and which reduces fibre losses when changing the paper grade or when adjusting the process.

The objective of the invention is thus to bring the solid material escaping from the primary fibre process back to said primary process as fast and as directly as possible.

In the preferred embodiment of the invention the fibre process of the short circulation is improved by avoiding upstream recycling of the main fibre process as well as its ramifications such as reject flows, thus providing a clear-cut and logical process without the operating problems of a process with many feedback loops.

The object of the invention is also to provide a papermaking process which is not subject to dirt and slime buildup and which thus will need significantly less cleaning than a traditional papermaking process.

The object of the invention is achieved by splitting at least a portion of the backwater draining through a forming fabric in a papermaking machine into at least two and preferably three or more separate flows and feeding them directly without passing any open vessels, as substantially air free separate flows to at least two and preferably three or more essentially separate points of stock dilution in the fibre process of the short circulation of said papermaking machine.

Although substantial advantages can be obtained by the present invention even if only a portion of the backwater is treated according to the invention, preferably all or essentially all of the backwater draining through the forming fabric is conducted to the short circulation in the direct separate and air-free manner of the present invention.

The backwater is preferably split into several, such as five to ten separate flows to be pumped in air-free condition directly to the fibre process. In a preferred embodiment of the invention the backwater is split into 15 or more separate flows. It may, however, in some embodiments be advantageous to combine two or more of the split flows to be pumped by a common pump into the short circulation.

The backwater first filtering through a forming fabric contains the largest amount of drained fibres. In the most preferred embodiment of the invention the backwater, which was first filtered through said fabric, is conducted to the last or next to last significant dilution stage of said short circulation. Thus a large amount of the drained fibres are quickly directed back into the fibre process.

A particularly preferred feature of the invention is reached when said backwater is conducted back to said short circulation as separate flows in a consecutive order of filtration to the consecutive dilution stages so that the first backwater goes to the last dilution stage, the second backwater to the second last dilution and so on. For certain purposes, such as the washing of the last cleaned fraction prior to the headbox, it may be advantageous to use water of less fibre content or even clean water.

In a particularly favorable embodiment of the invention backwater is fed directly to the reject dilution of an integrated multi stage centrifugal cleaner and a pressurized screen with internal dilution, thus avoiding ramifications and upstream feedback in the fibre process.

The apparatus according to the present invention comprises in the short circulation of a paper machine at least two stock dilution devices, a headbox and a looped forming fabric as well as means for collecting backwater at said forming fabric and feeding it back into the fibre process. In order to implement a fast air free split recycling said apparatus comprises at least two and preferably three or more separate backwater collecting means at said forming fabric, at least two and preferably three or more of them being in direct flow connection with a pump of its own for returning said backwater directly in an essentially air free condition through separate backwater recycling pipes without open vessels to said at least two separate stock dilution devices or their substantially separate water distribution means.

In a preferred embodiment of the invention there are at least three and preferably a multitude such as up to 50 or more backwater collecting means in the machine direction. Preferably there are also several such as 2 to 20 backwater collecting means in the cross machine direction. Separate flows of collected backwater are pumped by separate pumps to separate stock dilution devices in said short circulation. The backwater circulation is preferably arranged so that the backwater recycling pipe from the first backwater collecting means i.e. the one or the ones closest downstream of the headbox, in process order is connected to the last stock dilution device, i.e. the one closest upstream of said headbox.

The invention is described in greater detail below referring to the accompanying drawings, wherein FIG. 1 represents the equipment used in the short circulation of a traditional papermaking process;

Figure 1:
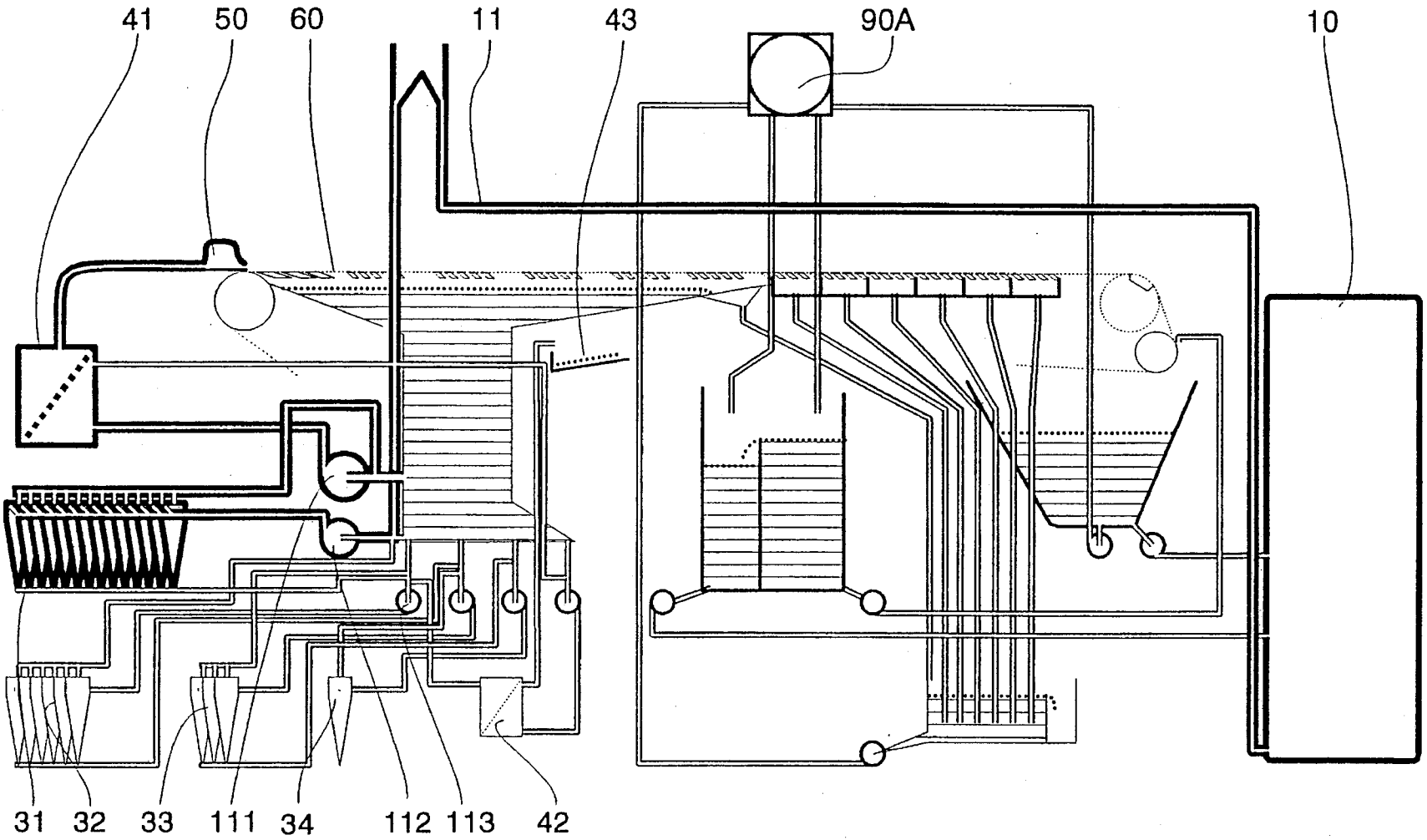

For a better understanding of the process of the invention, a traditional papermaking process is first explained making reference to a conventional papermaking process shown in FIG. 1. The main fibre process is marked in FIG. 1 with a fatter line. Thus, stock from the stock preparation 10 is brought through a stock feeding line 11 to the backwater circulation at mixing pump 112 and further to a first cleaner stage 31. The accept stock from said cleaner stage 31 is brought to mixing pump 111 and further through a primary screen 41 to a headbox 50, from which the stock is discharged on a forming fabric or wire 60. A significant part of the backwater filtering through said wire 60 is collected into a backwater tank 121, from where it flows into the mixing pumps of the fibre process. The backwater filtered at the downstream end of said wire is collected into a common white water tank 122 and recycled back to stock preparation 10 in the long circulation of said paper machine together with any waste stock.

The reject from said first cleaner stage 31 is brought back to the back water system and further to a second cleaner stage 32. The reject of said second cleaner stage 32 possibly with part of the accept thereof are conducted via backwater piping to a third cleaner stage 33. In a similar way the reject of said primary screen 41 is conducted via a backwater piping to a second screen 42.

Due to the huge recycling system and large undefined open surfaces the process is stable but extremely slow and reacts only slowly to changes in process parameters. In the slow process also a danger of dirt build-up and clogging prevails.

Figure 2:
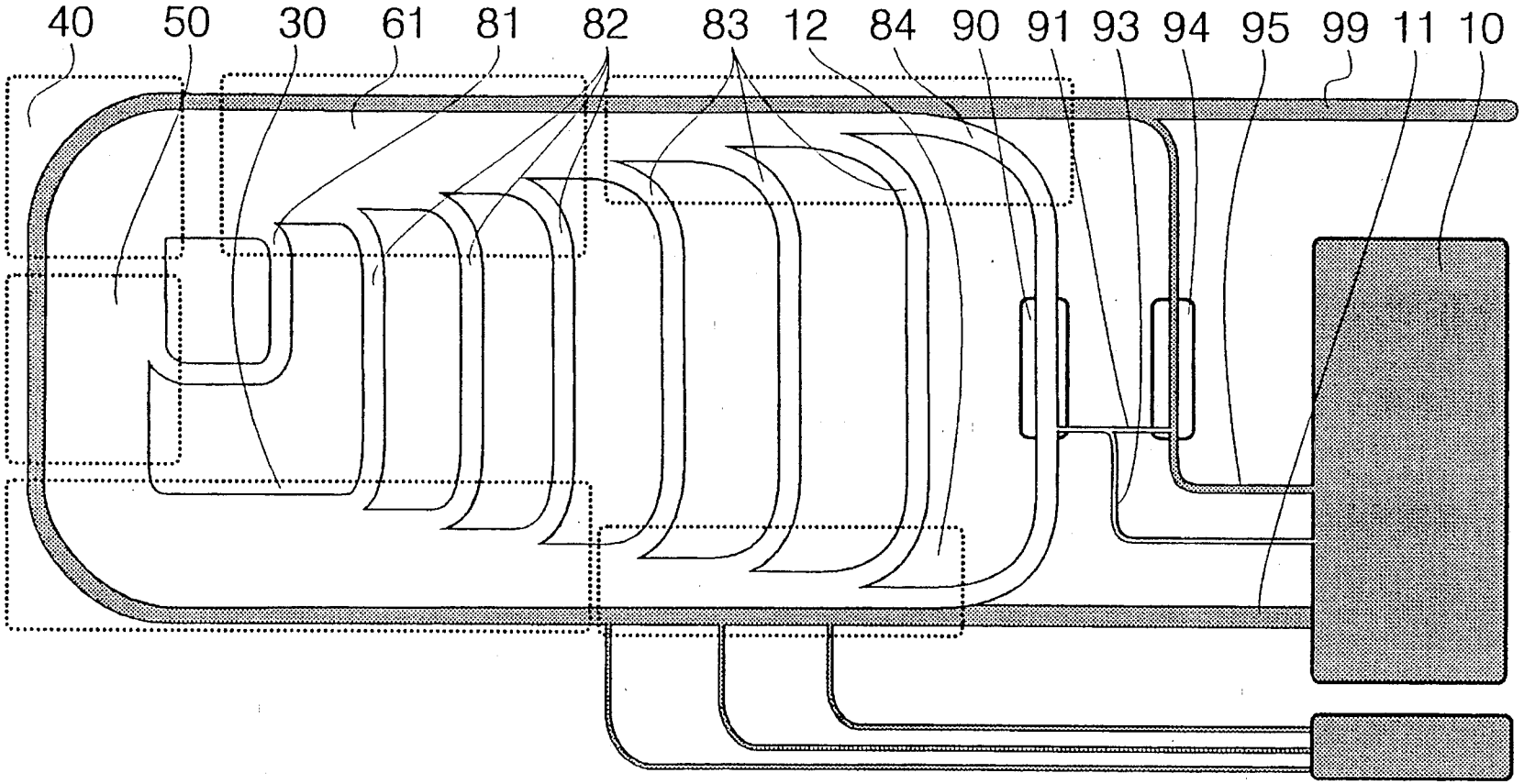
FIG. 2 represents a Sankey diagram of a process according to preferred embodiment of the invention.

FIG. 2 represents a Sankey diagram of the preferred embodiment of the invention, which clearly shows the advantages of the invention. The numbers in FIG. 2 refer to equipment which is described in detail in connection with FIG. 3.

Thus, in a process according to the invention backwater is recycled rapidly and cleanly without any upstream recycling. Ramifications, open tanks and aeration of the backwater are avoided. The stock 10 is stepwise diluted with backwater in different mixing and cleaning stages 12, 30, 40, The backwater with the highest fibre content is brought fastest from the forming zone 61 back to the dilution point 40 closest to the headbox 50.

Considering a paper machine width of about 2 to 10 meters and a length of the wire table of about 8 to 20 meters and further flow speeds of about 5 to 15 meters per second, the cycle times for the circulation loops are roughly about 5 to 20 seconds. As person skilled in the art knows a very large portion of the total amount of backwater drains through the forming fabric close to the head box. Moreover the backwater first draining through the forming wire includes a major portion of all the fibres draining through the fabric. The above mentioned shorter loop times refer to the shortest loops, i .e. the backwater containing the most fibres.

The backwater system according to the diagram of FIG. 2 has no ramifications and thus, the volume of circulating water can be kept small, dead angles are avoided and a fast flow keeps the pipes clean. At a change of paper grade a new equilibrium is reached fast and in a controlled way and the relatively high flow rate will keep the system clean without a need for washing.

Figure 3:
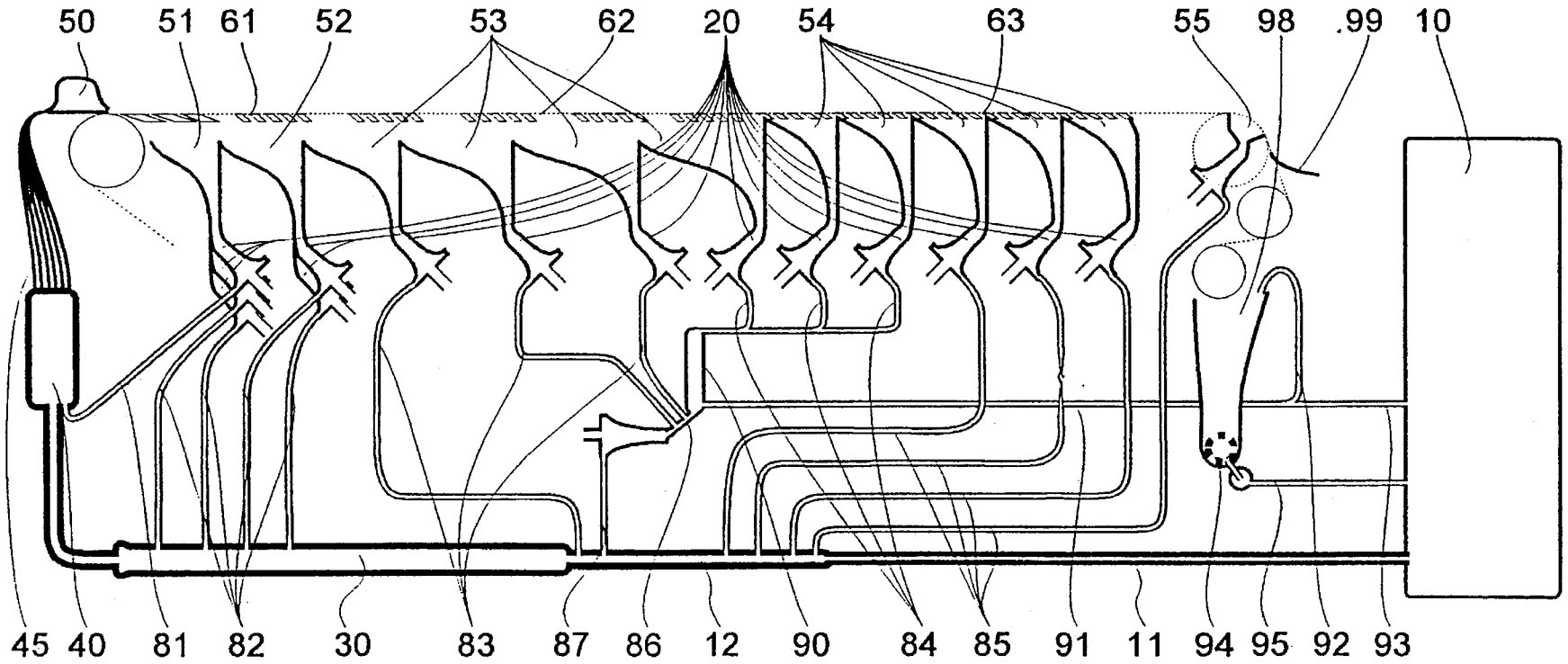
FIG. 3 represents the preferred embodiment of the invention.

The invention is further explained referring to a favorable embodiment represented by FIG. 3. According to the invention the stock is prepared exactly according to quality requirements in a known manner in the stock preparation 10 and is fed to the short circulation as a controlled flow 11 at a consistency of about 3 to 5%, or higher. The main fibre process is marked with a fat line passing through equipment number 10, 11, 12, 30 and 40, as explained below.

The short circulation in this description and the accompanying claims is intended as the process steps after feeding the stock until the last point of the web formation, from where the filtered white water is still fed back to the stock feeding or following process stages. Also the measures for feeding the respective backwater to said stock feeding or following process stages are part of the short circulation. in FIG. 3 the short circulation thus covers the process between the flow 11, the paper web 99 and return flow 91. The fibre recovery unit, 90 is included in the short circulation, which is particularly favorable, while in traditional systems it is rather part of the long circulation, or at least constitutes a long loop of its own.

In the mixer 12 stock is diluted to a consistency suitable for sorting in the centrifugal cleaner 30, typically 0.5 to 1.5%. The mixer can be a simple stock pipe or, if needed, equipped with mechanical mixing means. In the mixer also various additives required for the papermaking can be added. After dilution the stock is fed to the centrifugal cleaner 30, which is preferably of a type according to the copending patent application Ser. No. FI-922,282, by the same applicant. Said cleaner functions in one stage, without recycling of the rejects. The stock cleaned and diluted in the centrifugal cleaner is brought forward to a pressurized screen 40, which is preferably of a type according to copending patent application Ser. No. FI-922,284, by the same applicant. Said screen functions in one stage, without recycling of the reject. It is evident that also other types of cleaners and screens may be used in the process.

The cleaned and further diluted stock is brought to the paper machine headbox 50. The feeding to the headbox is favorably done by means of a flow distributor manifold 45, composed of a multitude of accept pipes of the screen 40, arranged so that they all are of equal length and further so that the number and curvature of their bends are essentially identical. By this arrangement an uniform distribution of stock over the width of the papermachine can be granted.

From the headbox 15 the stock is distributed onto the forming wire 60, and backwater drains into multiple consecutive draining boxes 51 to 54. According to the invention, there are at least two draining boxes, but favorably their number is considerably larger, possibly even fifty or more. In connection with the present specification and the appended claims the area of the forming fabric, which is completely covered by water, and where the fibres are still suspended in water, is called the forming zone 61. This is where the paper web is formed, and where the fibres find their definitive position in the web.

The draining boxes are shaped so that the backwater flows rapidly and with accelerating speed towards an outlet of the box, directly connected to a gas separation pump 20. The pump is preferably of the kind defined in the same applicant's copending patent application Ser. No. FI 922, 283. Said pump comprises a rotor rotating inside a hollow shell consisting essentially of an elongated gas separation part and a larger diameter pump chamber connected thereto. The inner wall of said gas separation part comprises a large gas separation surface for the essentially complete separation of air from a mixture of air and liquid rotating as a thin layer at said wall. The vanes of said rotor have essentially the same configuration as said gas separation surface and extend close to said surface for providing an essentially laminar flow of the liquid along said separation surface.

The air is separated from the backwater and the backwater is pumped as a separate direct stream to the fibre process. The gas separation pumps being self adjusting, so that all water arriving will be pumped further, there is no further need for flow control, but the flow is determined by the draining into each draining box. If other kinds of gas separation pumps are used flow control may be needed.

The drainage is most intensive at the beginning of the forming zone 61, where also the retention is at its lowest and consequently the solids contents of the backwater highest. In order to obtain an optimum distribution of the backwater drained here, and in order to bring it back to the fibre process as fast and as close to the headbox 50 as possible, the draining boxes 51 and 52 are split also laterally in the cross direction of the wire. These split flows are then pumped directly to the respective dilution points, the screen 40 and centrifugal cleaner 30.

After the forming zone 61 follows a second draining zone 62, where water is still easily drained and the retention of fibres increases. The water here is collected in second draining boxes 53, and pumped partly to a mixer 12, partly to a foam abatement device 86 of a saveall 90 and partly to a saveall fibre recovery 90. The distribution of the flows can be arranged in different ways according to the needs of different applications.

In a vacuum draining zone 63 following said second draining zone 62 draining is promoted by applying vacuum to suction draining boxes 54 and to a suction roll 55. This suction is preferably generated in a common vacuum system (not shown) and can be applied through the respective gas separation pumps, thus accelerating the flow to the pumps and facilitating deaeration in the pumps.

Excess backwater 91 is discharged from the short circulation and split into a couch pit dilution flow 92 and stock preparation discharge 93 in the same proportion as the web formed is split into couch broke 98 and paper web 99. In this manner the composition of a couch broke discharge 95 remains almost identical to the composition of thick stock 11, which, compared with the common practice of diluting and rethickening, greatly facilitates the handling and recycling of the couch broke 98.

Figure 4:
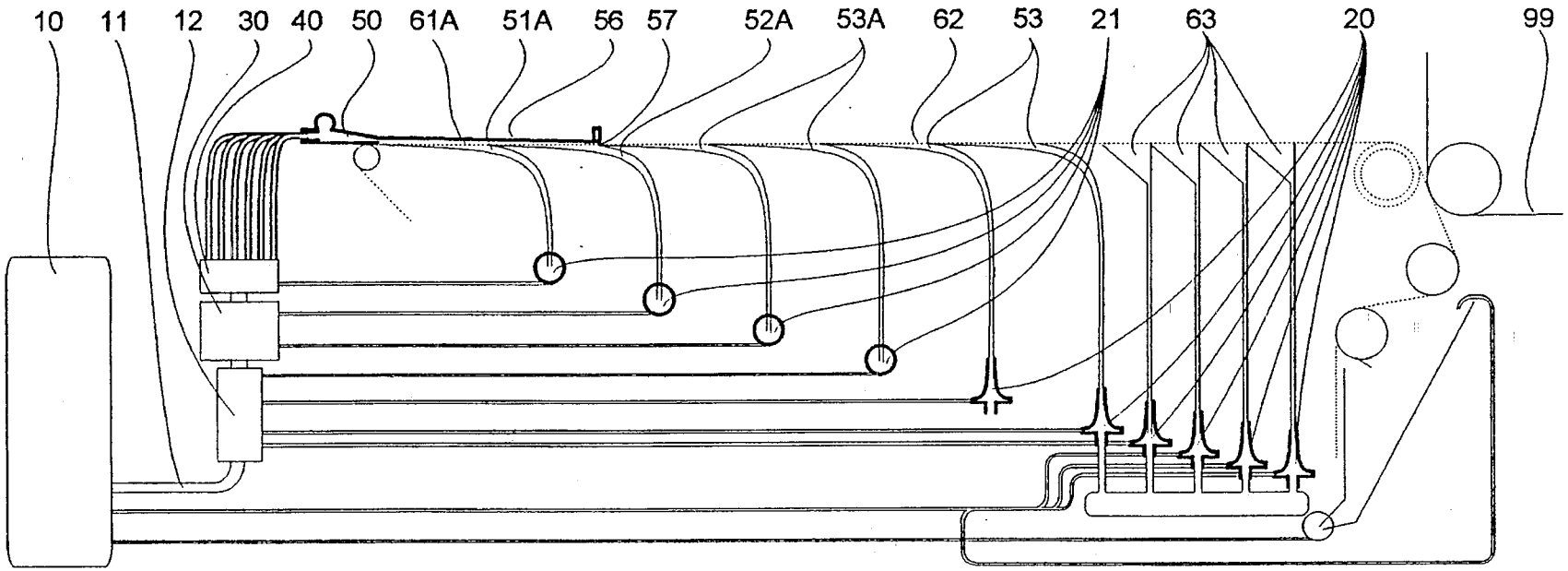
FIG. 4 represents a flow diagram of a process according to an embodiment the invention, having a partially closed formation zone.

In a partially closed forming represented by FIG. 4 stock is brought from the headbox 50 to an air free, closed forming zone 61A. In the embodiment of FIG. 4 this is a hydraulically defined space, limited by the headbox side walls or other suitable sealings in the lateral direction and the paper machine forming fabric 60 at the first draining boxes 51A and 52A. In a direction parallel to the wire, the space is limited by a second forming fabric similar to the fabric 60 or a wall or the upper lip 56 of the headbox. In said closed forming zone a significant part, even 50% or more, of the water is removed from the stock suspension. The rest of the water passes with the formed fibre web through the lip opening 57 onto an open forming zone 62.

In the embodiment represented by FIG. 4 the draining of backwater is continued on the open forming zone 62 into draining boxes 53A. A water film covers the wire in the forming zone, and draining boxes 51A, 52A and 53A can be kept flooded and sealed by this backwater so that no air enters into them. Backwater flow to pumps 21 is thus essentially free of air, and can be recycled directly to the short circulation fibre process. It is evident that the closed forming zone 61 A can be longer or shorter, and that the quality of the formed web can be influenced over the length and the shape of the closed space.

At the end of forming zone 62 the amount of water has reduced to an extent where air may pass through the forming fabric with the draining backwater. Thus, the backwater from draining boxes 53 is pumped with gas separation pumps 20 free of air to the short circulation.

Figure 5C:
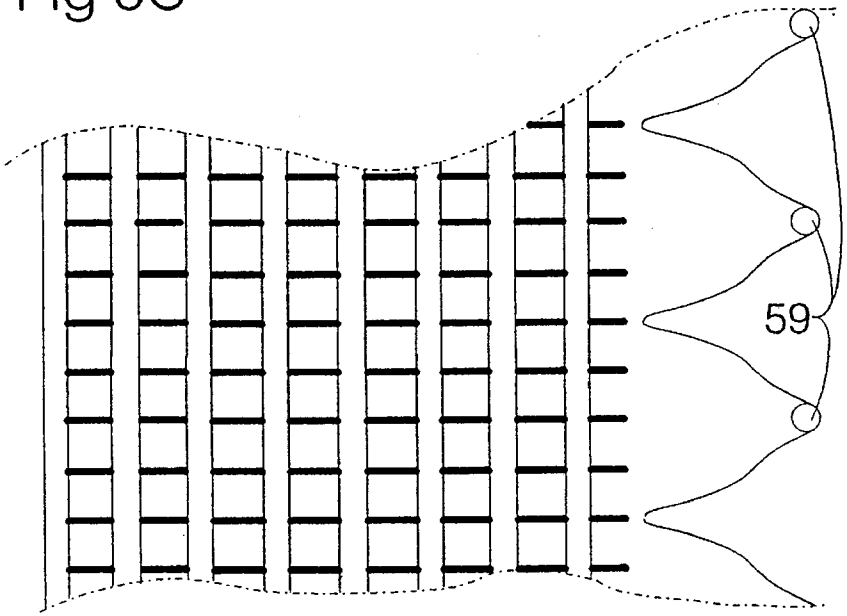
FIG. 5C represents a view of the forming box represented by FIG. 5A seen from above.
Figure 5A:
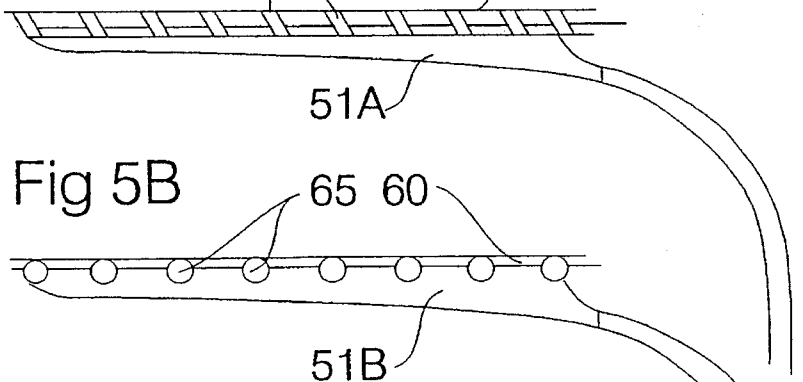
FIGS. 5A and 5B represent alternative embodiments of forming boxes used in the embodiment of the invention represented by FIG. 4.
Figure 5B:
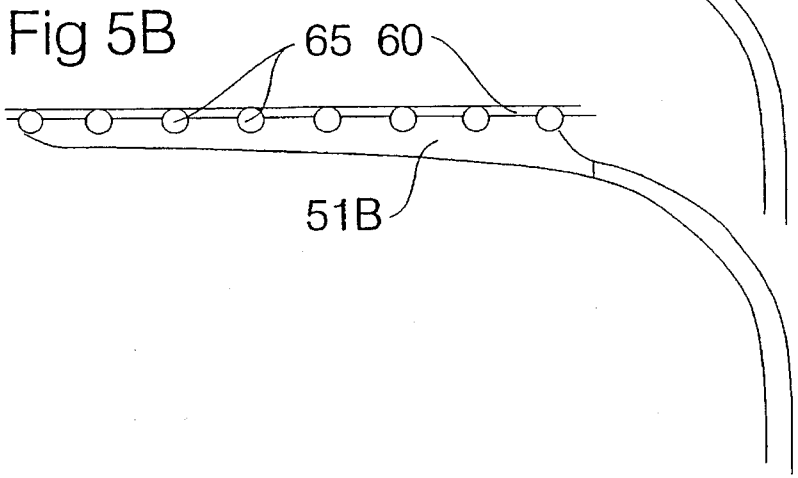

Draining boxes 51A . . . 53A, 53 are favorably of a type as represented by FIG. 5A or 5B, designed especially for a process according to the invention. These draining boxes, 51 A, 51 B are of a flat shape, which permits them to remain flooded with water. The forming fabric 60 is supported into the draining boxes aided ether by foils 64 according to FIG. 5A or supporting bars 65 according to FIG. 5B. Due to the flat shape of the draining boxes 51A, 51B the volume of the water contained in them is small and the water is promptly recycled. The flooded boxes produce an air free, hydraulically defined flow, the flowing speed of which can be considerably high.

FIG. 5C represents a draining box 51A or 51B seen from above, and shows that the outlet end of the box has been divided laterally in multiple channels promoting a fast and uniform draining. The channels can be 2 . . . 100. The channels narrow in the downstream direction to form separate backwater pipes 59, which are connected to the circulation pumps of the respective draining box. According to the invention the backwater from separate outlet channels can be brought to separate pumps or alternatively the water from adjacent draining boxes or outlet channels can be grouped together, feeding a common pump.

FIG. 5C also shows the machine direction beams of the draining box 51 A or 51 B supporting the dewatering elements or foils 64 or 658, which also reinforce said draining box, without extending to the immediate vicinity of the forming fabric, where they could disturb the flow through and from the forming fabric.

If the outlet pipes 59 of draining box 51A are connected before the pump, one has to take care that the diameters, bows, lengths and other factors which affect the flow resistance are arranged to be equal, so that an equal flow will result from every equal transverse area.

In the area following after the forming zone 62 the essential part of the water has been removed. In this area air will be sucked through the web into the backwater and has to be removed by gas separation pumps before recycling as in the embodiment of FIG. 3. By means of allowing air to enter into the boxes and removing it by means of gas separation pumps the pressure distribution can be made uniform. Further, the flow speed of the backwater can be increased in the piping.

Figure 6:
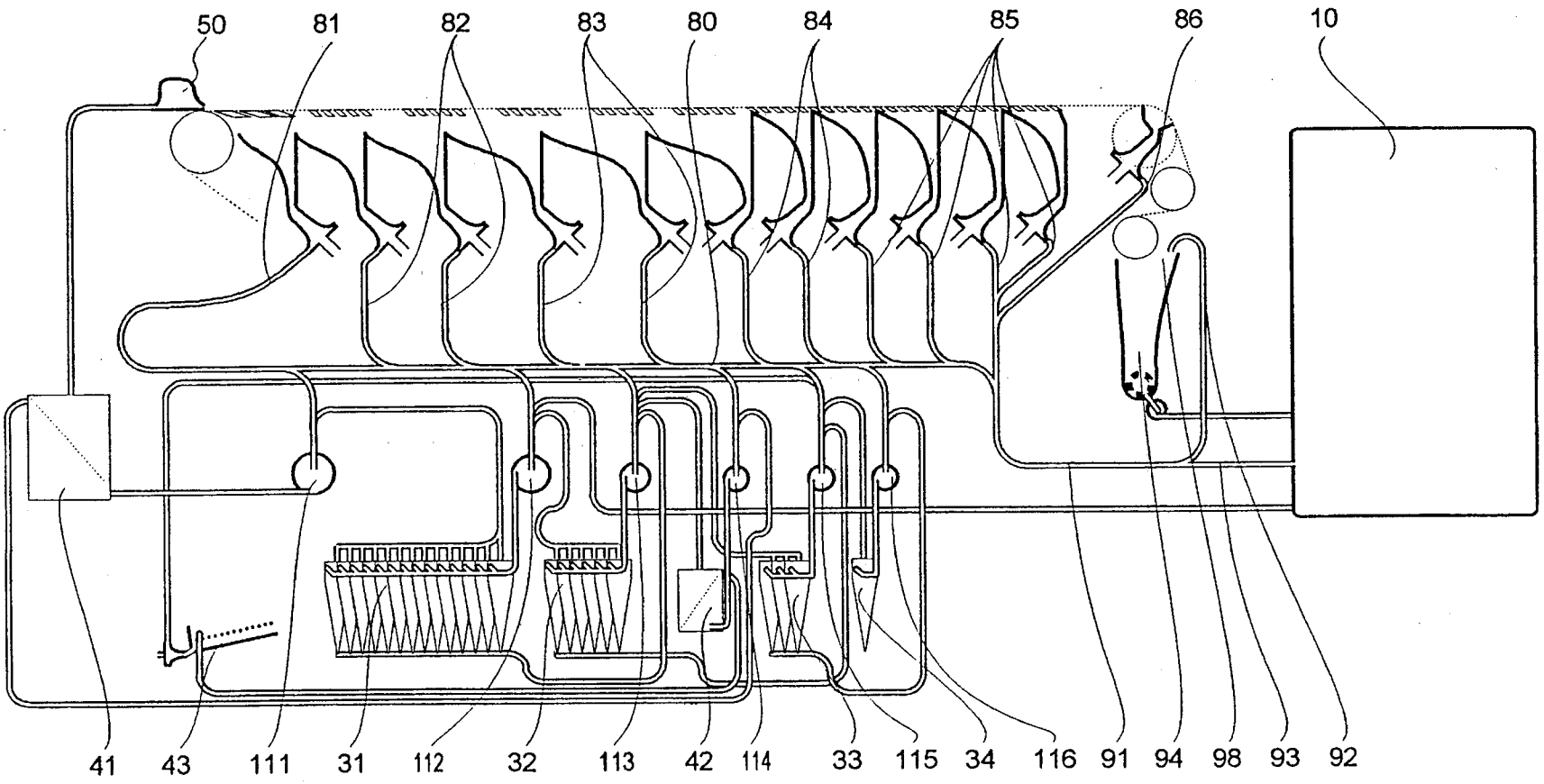
FIG. 6 represents a flow diagram of a process according to an embodiment the invention, wherein essentially traditional process equipment is used in the fibre process.

In FIG. 6 the same numbering is used as in FIGS. 1 and 3. FIG. 6 shows the principle of the present invention applied in connection with traditional cleaning equipment and the same fibre process as in FIG. 1.

According to FIG. 6 the backwater is brought into this traditional fibre process directly from the forming zone, by means of gas separation pumps as air free separate flows without using open vessels, where the backwater flow would be held or retarded. The backwater is pumped to a backwater distribution pipe 80 in a sequence of decreasing fibre content and so distributed that a sufficient availability of dilution water is granted for each of the mixing pumps 111 to 116. Excess backwater 91 is split between couch pit 94 and stock preparation 10 in the proportion of couch broke 98 and paper web 99.

In this manner the large volume backwater tanks of a traditional paper machine can be eliminated. The return flow of the fibres drained through the forming fabric may be optimized so that the backwater richest in fibres makes the shortest circulation.

This process can be improved by including one or more of the integrated multi stage equipment shown in FIG. 3, i.e. a cleaner 30, a screen 40 or a saveall 90 into the short circulation. Similarly these components can also be added to a traditional paper machine wet end with conventional backwater tanks, improving the performance of the same. In the latter case backwater can be fed to the dilution of the respective equipment as separate, air free flows, according to the invention, by means of conventional pumps fed from the backwater system.

A comparison was made between a traditional paper machine wet end according to FIG. 1, a wet end according to the preferred embodiment of FIG. 3 and the embodiment with conventional process equipment according to FIG. 6. The slowness of response to a change of process settings according is indicated in the following Table calculated according to the following formula representing the amount (N) of material delaying the change:

$$N=C_f \times V_f \times T_c$$

wherein $C_f$ fibre concentration in the flow (gram/liter)

$V_f$ volume flow (liter/minute)

$T_c$ circulation delay time (minutes)

TABLE

Approximation of the amount of material circulating outside the primary fibre process

| | Traditional (FIG. 1) | Preferred (FIG. 3) | Hybrid (FIG. 6) |
|---|---|---|---|
| Fibre Process | 1500 | 0 | 1000 |
| White Water | 1300 | 50 | 200 |
| Fibre Recovery | 5500 | 50 | 50 . . . 500 |
| Couch Broke | 4000 | 100 | 100 . . . 400 |
| TOTAL | 12300 | 200 | 1350 . . . 2100 |

The figures show the slowness induced through feedbacks in the fibre process, the circulating backwater, the fibre recovery saveall loop, and the couch broke and total slowness. Thus the preferred embodiment according the present invention gives an improvement of about sixty times compared to a traditional process, whereas even a hybrid embodiment according to FIG. 6 provides an manifold improvement. There are many variations possible, and the results can be achieved in different steps and different ways.

It is obvious for the person skilled in the art that the invention may be modified in many different ways without deviating from the spirit and scope of the invention. Thus, the benefits of the invention may be achieved in conjunction with traditional processes and traditional equipment as well as with equipment which further utilize all the advantages of the invention.

I claim:

1. A process for making paper or board while recycling backwater in a papermaking machine, the machine including a short circulation wherein the backwater draining through a paper forming fabric of the machine is used for papermaking stock dilution, the process comprising:

splitting at least a portion of the backwater draining through the forming fabric into at least two separate backwater flows; and pumping each of said backwater flows directly and separately without passing through any open air-containing vessels, such that said backwater flows are substantially air free separate flows to at least two essentially separate points of short circulation stock dilution.

2. The process according to claim 1 wherein the portion of the backwater draining through a forming zone of said forming fabric is split and conducted to said short circulation in a direct, separate and air-free manner.

3. The process according to claim 1 wherein the portion of the backwater is split into, five to ten of the backwater flows.

4. The process according to claim 1 wherein the portion of the backwater draining through said forming fabric is split in a machine direction of motion of the forming fabric into 3 to 50 and in a cross direction perpendicular to the machine direction into 2 to 20 separate flows.

5. The process according to claim 1 wherein the portion of the backwater drained immediately downstream of a headbox of said papermaking machine is fed to a dilution point immediately upstream of said head box.

6. The process according to claim 2 wherein the backwater is fed directly as separate flows in the consecutive order of draining in the machine direction so that the flow first drained is fed into a last dilution stage, the second flow drained is fed to a next to last dilution stage, and so on.

7. The process according claim 1 wherein the portion of the backwater draining through said forming fabric is collected as separate flows into flooded draining boxes disposed below said forming fabric.

8. A process according to claim 1 wherein air is removed from the drained backwater by means of gas separation pumps.

9. The process according to claim 8 wherein the portion of the backwater drained through said forming fabric is fed by gas separation pumps as multiple separate flows free of air and without open vessels to process stages of the process.

10. The process according to claim 2 wherein the backwater is split into five to ten separate flows.

11. The process according to claim 6 wherein air is removed from the drained backwater by means of gas separation pumps.

12. The process according to claim 1 wherein the portion of the backwater is split into 15 or more separate flows.

13. The process according to claim 1 wherein each of the backwater flows draining through a forming zone of the forming fabric is pumped directly to a respective one of the separate points of short circulation stock dilution.

14. The process according to claim 1 wherein the backwater flows are pumped through a common backwater distribution system prior to delivery to the separate points of short circulation stock dilution.

15. The process according to claim 1 wherein the backwater flows are maintained at a speed of at least 3 meters per second.

16. The process according to claim 2 wherein the portion of the backwater is split into 15 or more separate flows.

17. The process according to claim 16 wherein said pumps comprise gas separation pumps.

18. The process according to claim 1, including a respective pump in each of said separate backwater flows, each respective pump pumping to one of the separate points of short circulation stock dilution.

19. An apparatus for circulating backwater in a papermaking machine having a short circulation, the machine comprising at least two stock dilution devices in flow communication with the short circulation, a headbox (50), a looped forming fabric (60), at least two separate backwater collecting means (51, 52, 53, 54; 51A, 52A, 53A, 53) for collecting backwater draining through said forming fabric (60), at least two of said collecting means being in direct flow communication with a respective pump (20; 20, 21) for returning backwater collected therein directly and separately without passing through any open air-containing vessels, such that the backwater is in a substantially air-free condition, to said at least two separate stock dilution devices (12, 30, 40; 111, 112, 113, 114, 115, 116) or substantially separate water distribution means in flow communication with the stock dilution devices (80), whereby a fast, air free and split recycling of backwater is implemented.

20. The apparatus according to claim 19 wherein there are 3 to 50 backwater collecting means in a machine direction of motion of the forming fabric and 2 to 20 backwater collecting means in a cross direction perpendicular to the machine direction.

21. The apparatus according to claim 19 wherein said pumps (20, 21) comprise gas separation pumps.

22. The apparatus according to claim 19 wherein the backwater collected in backwater water collecting means (51) closest downstream of said headbox (50) is connected to a first dilution point (40; 41) closest upstream of said headbox (50).

23. The apparatus according to claim 22 wherein the backwater collected in further water collecting means (52) downstream of said headbox (50) is connected to the first dilution point or a second dilution point next to closest (30; 31) upstream of said headbox (50) .

24. The apparatus according to claim 22 wherein said first dilution point closest upstream of said headbox comprises a pressurized screen (40), which functions in one stage without recycling of rejects, and said second dilution point next to closest upstream of said headbox comprises a centrifugal cleaner (30), which functions in one stage without recycling of rejects.

25. The apparatus according to claim 19 wherein said backwater collecting means (51A, 52A, 53A) at a forming zone (61) are flat draining boxes (51A, 51B) flooded by water.

26. The apparatus according to claim 20 wherein said pumps (20, 21) comprise gas separation pumps.

27. The apparatus according to claim 26 wherein the backwater collected in backwater water collecting means (51) closest downstream of said headbox (50) is connected to a dilution point (40; 41) closest upstream of said headbox (50).

28. The apparatus according to claim 19 including means for maintaining the backwater flows at a speed of at least 3 meters per second.

29. The apparatus according to claim 20 wherein said backwater collecting means in the machine direction are connected to separate respective pumps.

30. The apparatus according to claim 20 wherein said backwater collecting means in the cross direction are connected to separate respective pumps.

31. The apparatus according to claim 29 wherein said pumps comprise gas separation pumps.

* * * * *